US009739563B1

(12) United States Patent
Tharp

(10) Patent No.: US 9,739,563 B1
(45) Date of Patent: Aug. 22, 2017

(54) BULLPUP STOCK ASSEMBLY WITH BREAK BARREL GUN

(71) Applicant: Daniel Tharp, Richardson, TX (US)

(72) Inventor: Daniel Tharp, Richardson, TX (US)

( * ) Notice: Subject to any disclaimer, the term of this patent is extended or adjusted under 35 U.S.C. 154(b) by 0 days.

(21) Appl. No.: 15/147,904

(22) Filed: May 5, 2016

Related U.S. Application Data

(63) Continuation of application No. 14/446,335, filed on Jul. 30, 2014, now abandoned.

(60) Provisional application No. 61/859,801, filed on Jul. 30, 2013.

(51) Int. Cl.
*F41B 11/00* (2013.01)
*F41B 11/70* (2013.01)
*F41C 23/00* (2006.01)

(52) U.S. Cl.
CPC ..... *F41B 11/70* (2013.01); *F41C 23/00* (2013.01)

(58) Field of Classification Search
USPC ..... 124/63, 66, 65
See application file for complete search history.

(56) References Cited

U.S. PATENT DOCUMENTS 553,716 A * 1/1896 Markham ..... F41B 11/642 124/66
631,010 A * 8/1899 Hamilton ..... F41B 11/642 124/66
4,709,686 A * 12/1987 Taylor ..... F41B 11/00 124/67
5,424,791 A * 6/1995 Campbell ..... F16M 13/04 352/243
5,575,270 A * 11/1996 Casas-Salva ..... F41B 11/73 124/67
7,959,046 B2 * 6/2011 Burnsed, Jr. ..... F41C 33/001 224/150

* cited by examiner

*Primary Examiner* — J. Woodrow Eldred
(74) *Attorney, Agent, or Firm* — Jeffrey Roddy

(57) ABSTRACT

A special stock assembly for break barrel air guns includes a bullpup stock assembly which allows a break barrel air gun to normally break without requiring any modification to the cylinder, or cocking mechanism. The invention can include the mechanical components of a break barrel air rifle as part of an original manufacture with the gun by moving the trigger assembly forward, or as an after market retrofit to an existing gun, in which case a cable linkage is provided between the in situ OEM trigger assembly and an additional trigger pull provided with the bullpup stock assembly. The cable linkage connects a forward trigger assembly to the OEM trigger and can have a 1:1 ratio of trigger movement between the forward trigger pull and the OEM trigger, or another ratio as determined by the linkage elements. The forward trigger assembly can be purely mechanical, or incorporate a servo and/or solenoid with a power source such as a battery to augment trigger pull by a trigger finger.

4 Claims, 11 Drawing Sheets

FIG.7
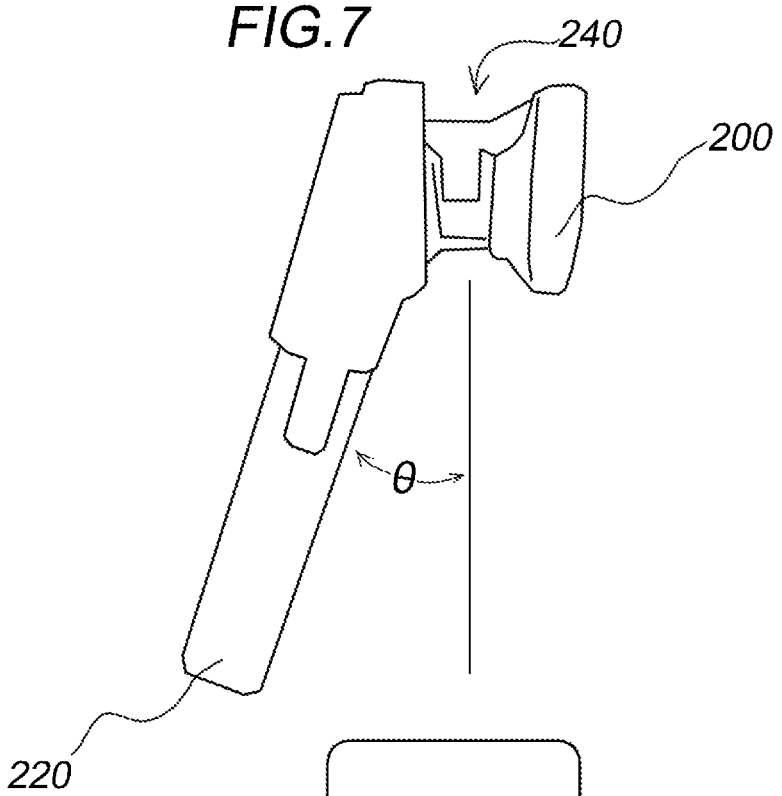
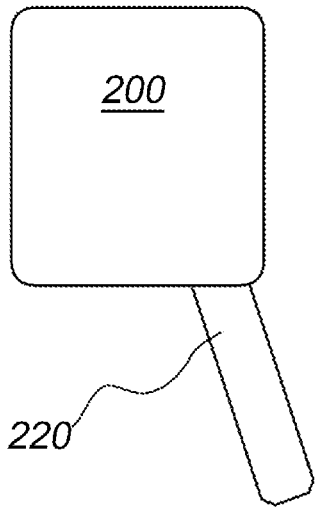
FIG.8

FIG.9
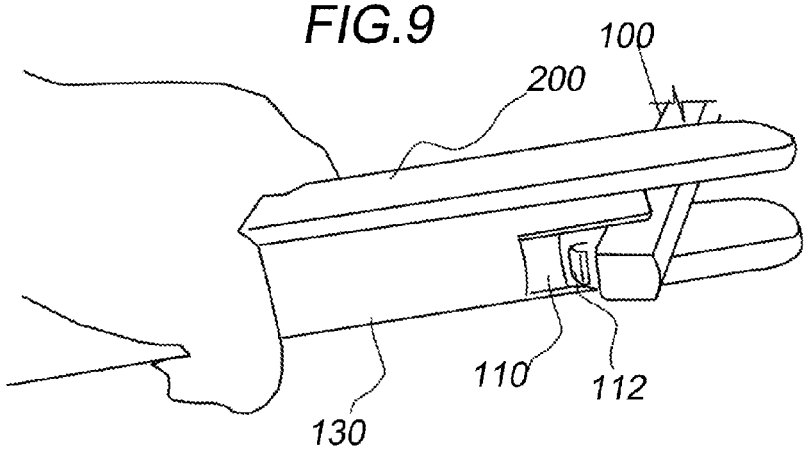
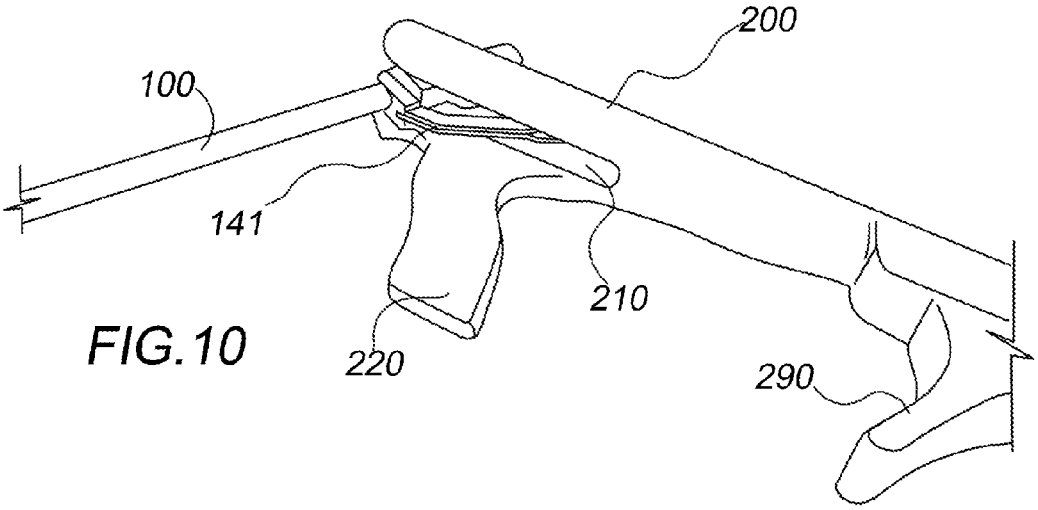
FIG.10

BULLPUP STOCK ASSEMBLY WITH BREAK BARREL GUN

CROSS REFERENCE TO RELATED APPLICATIONS

This application is a continuation of U.S. Non-provisional application Ser. No. 14/446,335 having a filing date of Jul. 30, 2014 titled "A Bullpup Stock Assembly with Break Barrel Gun" which claims the benefit of U.S. Provisional Application No. 61/859,801 filed Jul. 30, 2013

FIELD

The present invention relates generally to a bullpup stock for break barrel air guns

BACKGROUND

In a "bullpup" type stock, the action of the gun is behind the trigger in front of a short buttstock. This results in a shorter overall firearm length and improves maneuverability.

Break barrel air guns contain either a spring-piston or a gas-spring in which a cylinder is pressurized by a cocking mechanism wherein the gun barrel is hinged midway between the barrel and cylinder assembly, and whereby the barrel operates as a cocking lever to compress the piston. Cocking of a break barrel rifle is often accomplished by bracing the butt of the stock against the thigh with the barrel pointing up and at an angle whereby the end of the barrel can be grasped and pulled downwardly causing a levered cocking mechanism to compress the piston. Being thus pressurized, the barrel is then raised and locked in normal inline position. Irrespective of the spring type employed, break barrel air guns are known for their accuracy and can propel a 177 cal pellet up to 1300 ft/sec. Because of the relatively simple mechanical pressurization means, these air guns have a high power to weight ratio and provide long and dependable service. Despite the many advantages of the break barrel air gun, cocking the gun can be awkward. Furthermore, the amount of force required for the cocking stroke is significant, with some persons experiencing fatigue after repeated cocking. Another issue is that the form of the cocking mechanism in most break barrel air guns has tended to promote homogeneity in stock design. It would be desirable therefore to provide a special bullpup stock assembly that among its many features, assists a user's body mechanics by providing a projecting fulcrum at or adjacent to the pivot point of the cocking mechanism while still permitting the gun to cock (break) normally.

SUMMARY

The present invention seeks to address, among other problems, the difficulty of cocking break barrel air guns by providing a bullpup stock assembly which allows a break barrel air gun to normally break without requiring any modification to the cylinder, or cocking mechanism. The invention can include the mechanical components of a break barrel air rifle as part of an original manufacture with the gun by moving the trigger assembly forward, or as an after market retrofit to an existing gun, in which case a cable linkage is provided between the in situ OEM trigger assembly and an additional trigger pull provided with the bullpup stock assembly. The cable linkage connects a forward trigger assembly to the OEM trigger and can have a 1:1 ratio of trigger movement between the forward trigger pull and the OEM trigger, or another ratio as determined by the linkage elements. The forward trigger assembly can be purely mechanical, or incorporate a servo and/or solenoid with a power source such as a battery to augment trigger pull by a trigger finger.

In one implementation, the present invention provides the comfort and maneuverability of a bullpup stock assembly to a break barrel air gun. Advantageously, the instant invention provides a projecting fulcrum in the form of a grip which can be placed against the torso; preferably just below the sternum, whereby the rifle is then easily cocked by keeping each arm substantially level with the other, as opposed to past cocking methods requiring awkward body mechanics.

In another implementation, the present invention provides for a specially shaped buttstock that partially rests on the shoulder of the shooter, (1) decreasing the length between the eye and the sight or scope, and (2) preventing the shooter's arms from over extending. The specially shaped buttstock also allows for hands-free resting of the gun in a downwardly pointing position.

In whatever aspect, at least one objective of the present invention is to improve both the useability and appearance of a break barrel gun. Advantageously, the stock of the present invention permits a one piece cocking linkage configuration as opposed to conventional two piece linkages that include a pair of connected levers. The one-piece configuration relieves the effort required to cock the rifle at a final stage of the cocking stroke. The instant invention provides hand grip interchangeability.

Other possible uses and combinations of disclosed aspects and features of the instant invention will suggest themselves to those having skill in the art, and benefit of this disclosure.

The foregoing and other objects, features, and advantages of the invention will become more apparent from the following detailed description, which proceeds with reference to the accompanying figures.

BRIEF DESCRIPTION OF THE DRAWINGS

FIG. 7 shows an end view of a preferred embodiment according to the present invention;

FIG. 8 shows an end view of a preferred embodiment according to the present invention opposite that of (FIG. 7);

FIG. 9 is an detail view showing the barrel pivoted downwardly;

FIG. 10 is detail view taken from a side opposite that shown in (FIG. 9);

In the following detailed description, like reference symbols in the various drawings indicate like elements.

DETAILED DESCRIPTION OF THE INVENTION

Reference Listing

Figure 1:
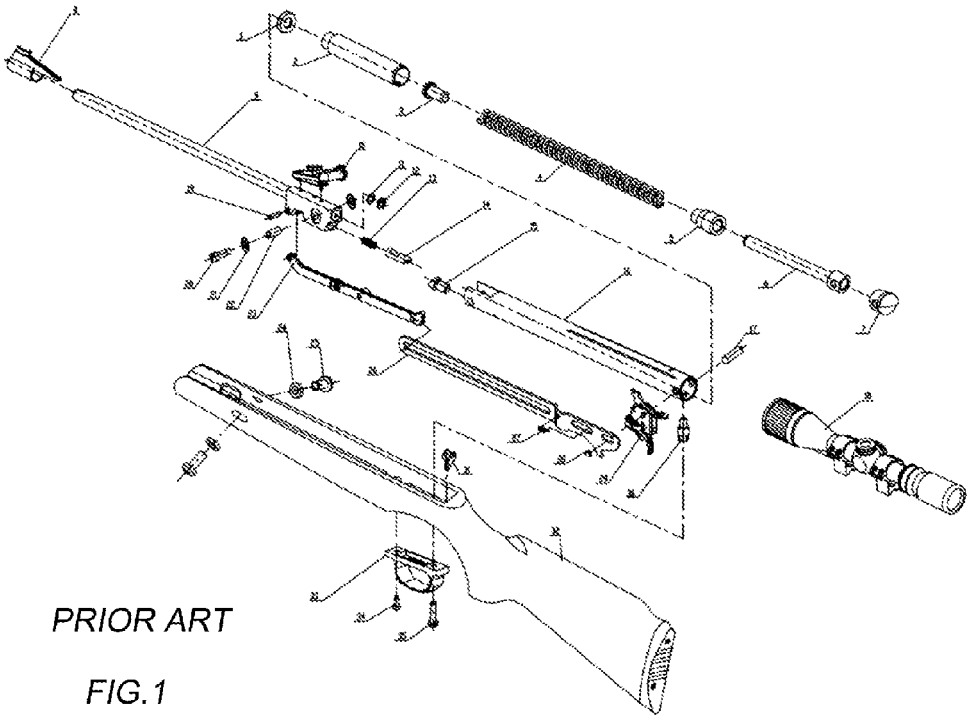
PRIOR ART FIG.1
FIG. 1 is an assembly view of a typical spring piston break barrel air rifle.

100 barrel
110 breech
112 breech lock
120 break
130 air cylinder
140 cocking mechanism
141 cocking linkage
150 OEM trigger
200 stock assembly
210 slot
220 grip
230 stub
240 recess
250 trigger
260 cable
280 attachment point
290 buttstock
300 drawbar
305 drawbar linkage
306 trigger guard
307 trigger guard slot
308 auxiliary trigger
310 servo
320 potentiometer
322 battery
330 motor
340 pulley

DEFINITIONS

In the following description, the term "air gun" refers generally to any air gun with single or multiple stroke cocking means, and more particularly to break barrel type air rifles. The term "cocking mechanism" refers to those portions of the air gun associated with cocking or pressurization functions and include at least the air cylinder, pivot pins, cocking levers, and the piston; whether spring or gas actuated. The term "conventional stock" refers to gun stocks where the action is forward of the trigger assembly, and the butt of the stock is braced against the shoulder. The term "body mechanics" refers to various positions assumed for physically cocking, carrying, and aiming the gun. Unless otherwise explained, any terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." Publications, patent applications, patents, and other references mentioned herein, if any, are incorporated by reference in their entirety for all purposes. In case of conflict, the present specification, including explanations of terms, will control. In addition, the materials, methods, and examples are illustrative only and not intended to be limiting.

Referring generally to FIGS. 1-21, in combination with a break barrel air gun AG possessing at least a barrel 100, a breech 110, an air cylinder 130, cocking mechanism 140 and cocking linkage 141, a special bullpup stock assembly 200 includes a formed recess 240 shaped and sized to accept certain mechanical components of a break barrel rifle and OEM rear trigger assembly if one is present. A slot 210 is formed at the bottom of stock assembly for the passing through of portions of the cocking linkage mechanism when the air gun is cocked. Hand grip 220 is either unitary or interchangeable with the remainder of the stock and provides a fulcrum for the cocking mechanism whereby improved leverage is obtained when cocking the rifle. Trigger 250 is connected by cable 260 or other linkage as will be appreciated by those having skill in the art and benefit of this disclosure to OEM trigger 150, or, in case of new manufacture, stock 200 is shaped and sized to accommodate an OEM trigger with direct linkage to the action. The stock assembly of the preferred embodiment has a buttstock 290 shaped and sized to rest atop a person's shoulder which is unitary with stock 200 or interchangeable with other buttstocks by means of threaded connectors, posts, or the like.

Figure 2:
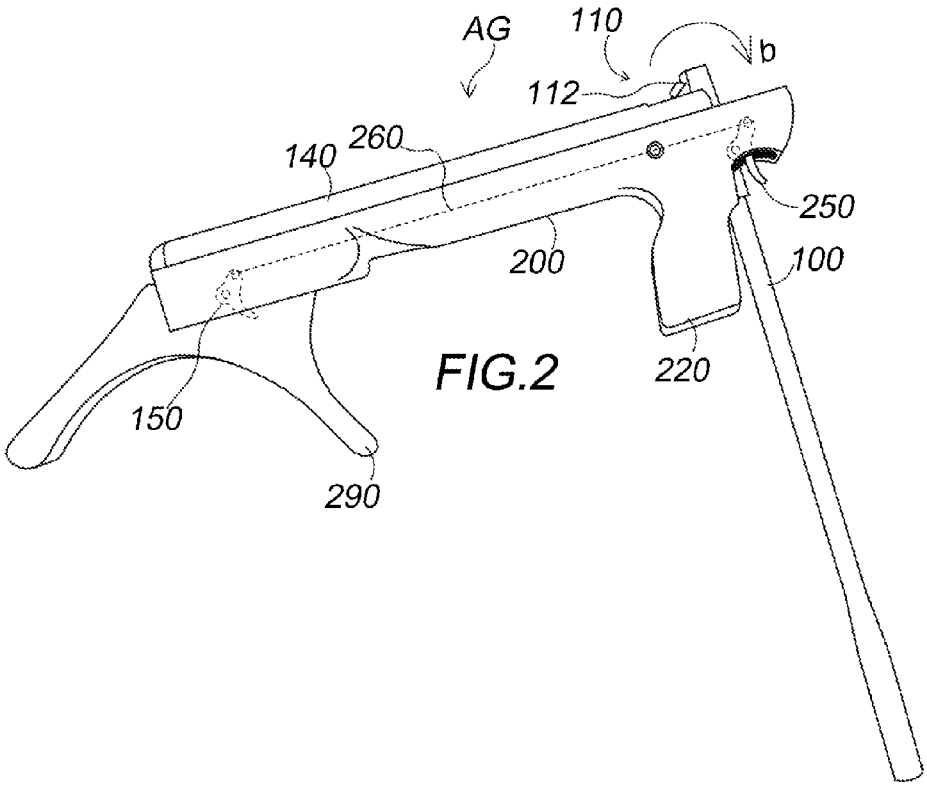
FIG. 2 shows a side perspective view of a preferred embodiment according to the present invention including a break barrel air gun (AG), stock assembly 200 and buttstock 290.
Figure 3:
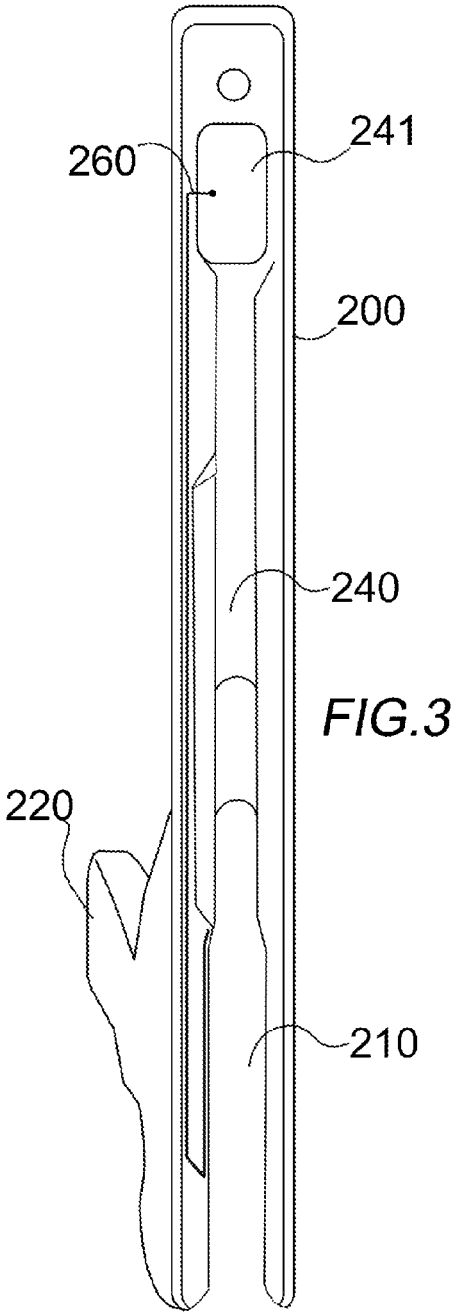
FIG. 3 shows a top perspective view of a preferred embodiment according to the present invention having an angularly offset stock, and wherein a stock 200 is shown having a cavity 240 shaped and sized to fit to the mechanical components of an air rifle.

Referring to FIG. 2, an embodiment is shown wherein the barrel is in cocking (broken) position. Dotted lines represent the cable linkage between the OEM trigger 150 and the forward trigger 250. It should be noted that the particular triggers shown are not to be considered limiting. The connection of the cable to the OEM trigger can be direct or via other trigger linking elements such as a cam or lever which is ultimately connected to the OEM trigger assembly.

Referring generally to FIGS. 3-8, stock 200 is shown in various profile views with buttstock 290 removed. Although in the particular embodiment depicted, buttstock 290 is connected to the stock via threaded bolt, the buttstock can be unitary with the remainder of the stock or other connections as will suggest themselves to those having skill in the art and benefit of this disclosure may be employed without departing from the claimed invention. Accordingly, any connecting or fastening means between the buttstock and remainder of the stock including mating connections with dovetail shapes or other shapes, and/or pegs or screws can be employed without departing from the spirit and scope of the disclosed invention.

Figure 4:
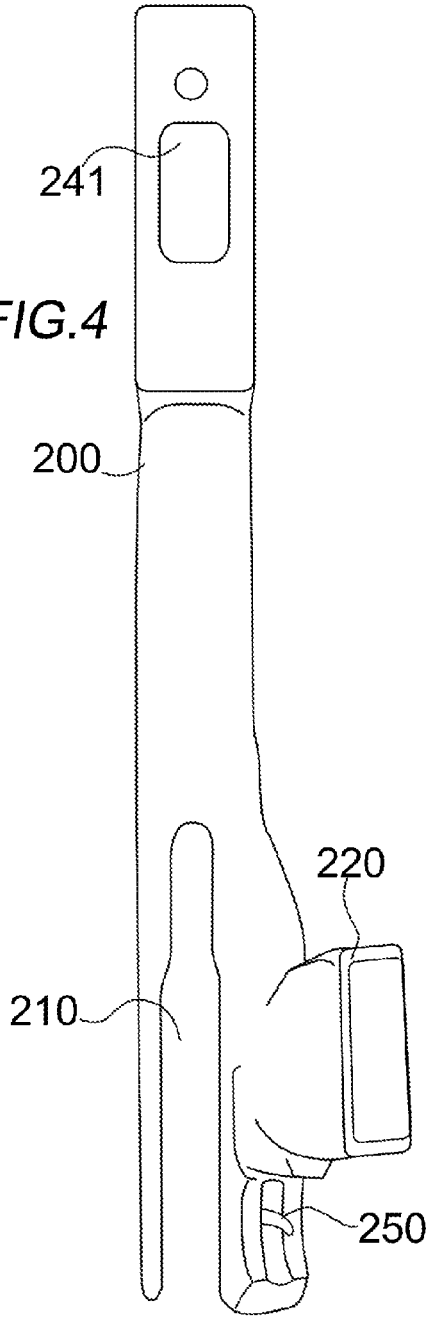
FIG. 4 shows a bottom perspective view of a preferred embodiment according to the present invention opposite that of (FIG. 3) wherein slot 210 permits the passing through of certain mechanical components of an air rifle.
Figures 5, 6:
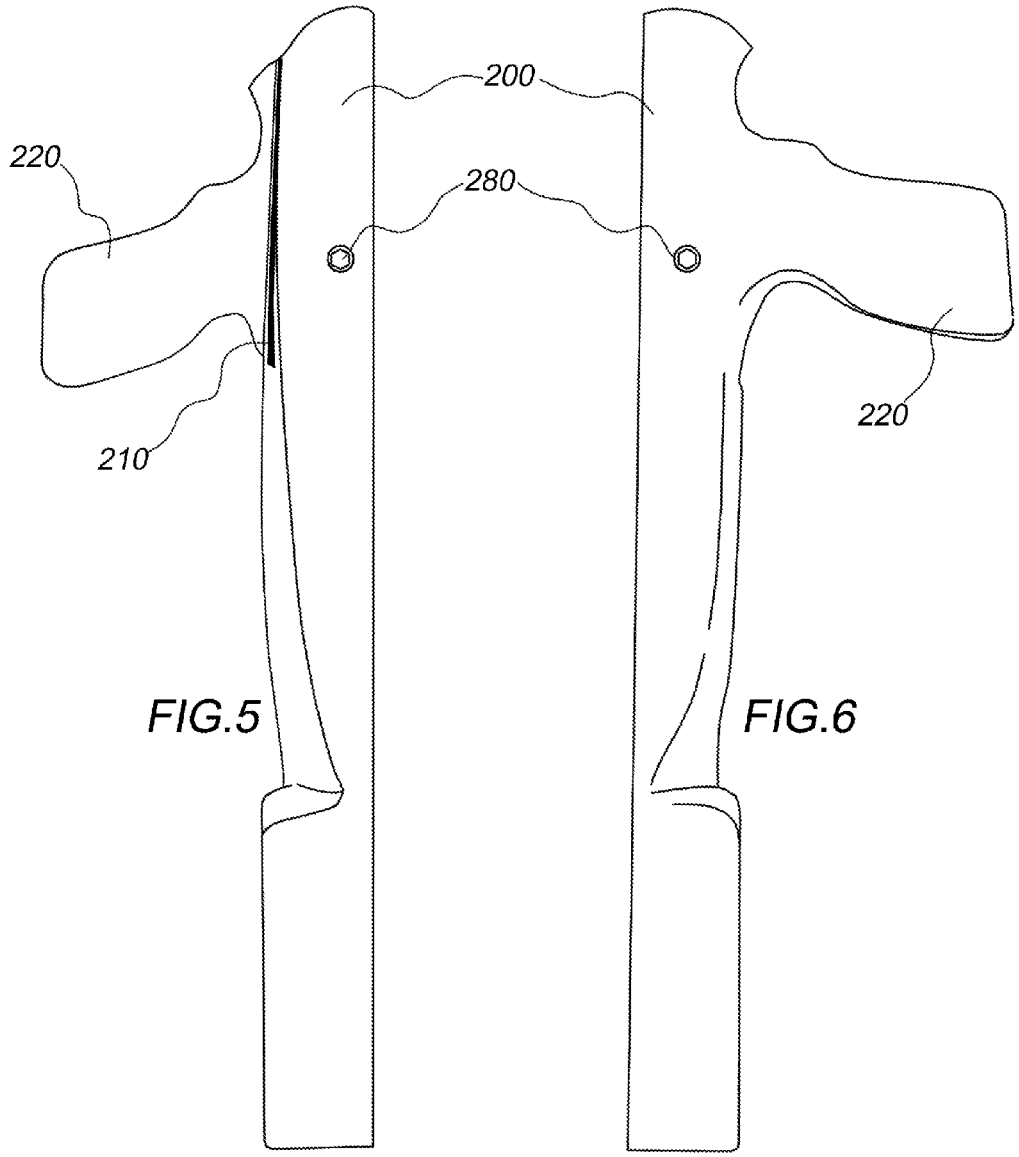
FIG. 5 shows a side perspective view of a preferred embodiment according to the present invention.
FIG. 6 shows a side perspective view of a preferred embodiment according to the present invention opposite that of (FIG. 5)

Referring to FIGS. 4, 9 and 10, slot 210 is formed to permit the passing through of certain portions of the air rifle, namely a section of the breech end of the barrel, and cocking linkages 141.

Figure 11A:
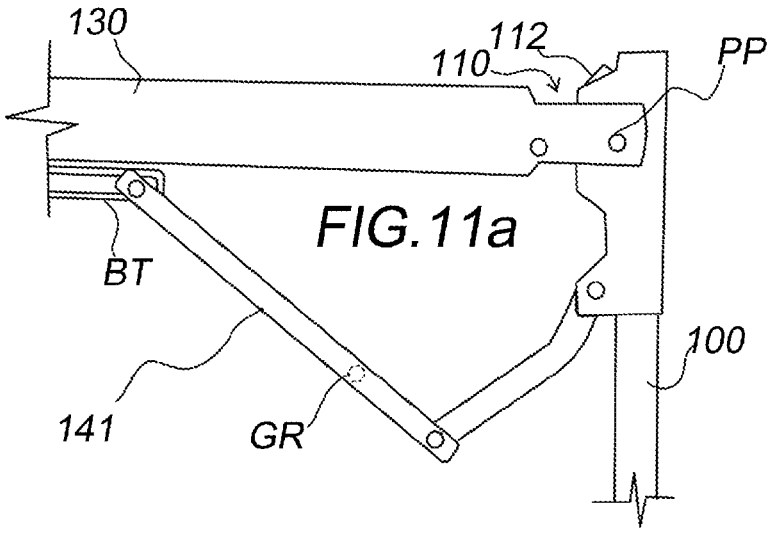
FIG. 11*a* is a detail view of a conventional cocking linkage which includes a pair of levers that are connected.
Figure 11B:
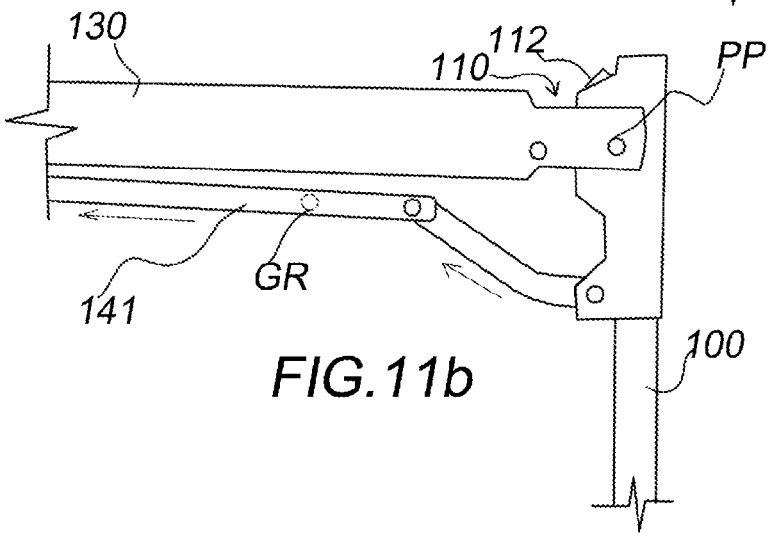
FIG. 11*b* is a detail view of a conventional cocking linkage which includes a pair of levers that are connected, and wherein guide roller (GR) is constrained by an inner portion of a stock, omitted in this view, to move in a motion generally parallel to the air cylinder 130.
Figure 12:
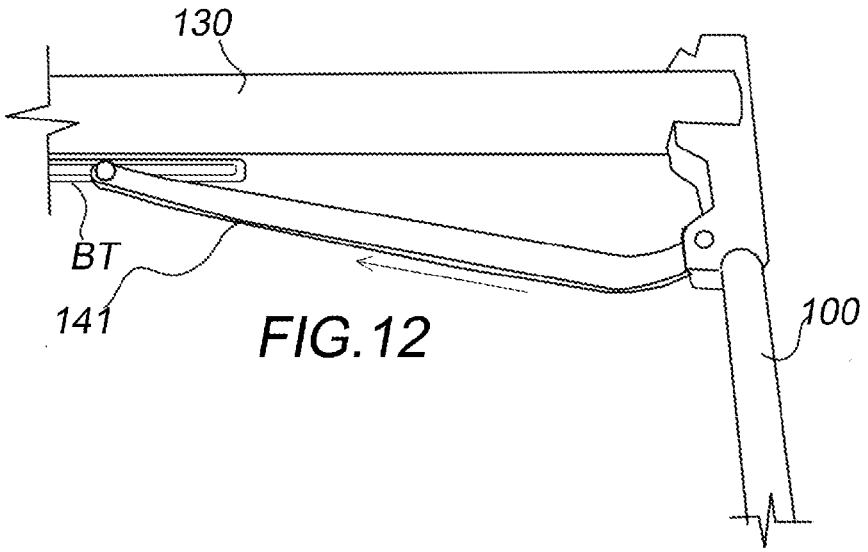
FIG. 12 is a detail view of a one piece cocking lever for use with a preferred embodiment according to the present invention.

Referring specifically to FIG. 11*a*, a cylinder and cocking mechanism of a typical break barrel air gun is depicted. Unless a stock is coupled to air cylinder 130 thereby constraining guide roller (GR) within an inner channel or groove of the stock (not shown), linkage 141 projects from the cylinder and barrel when in the barrel is drawn into cocking position. FIG. 11*b* shows the position of the cocking linkage when a stock—omitted here for clarity, is fitted to the air cylinder. The two part configuration (FIGS. 11*a*, 11*b*) of conventional air rifle cocking linkages, while adequate to pressurize the cylinder, is in part, a design concession to emulate the appearance of a non-air rifle, and is not an optimal configuration for ease of use. Generally, the foregoing configuration, while providing for easier initial breaking, is followed by more difficulty when the barrel is past the 90 degree position due to the direction of force applied to the shorter lever. Accordingly, in a preferred embodiment, as depicted in FIG. 12, a one-piece cocking linkage is provided so that superior mechanical advantage is obtained when the barrel and stock are drawn together in the final stage of the cocking stroke. This is important because the configuration of disclosed embodiments and especially the grip as a fulcrum already provides for easier initial breaking. The one-piece cocking linkage further reduces the total amount of effort required to cock the break barrel rifle.

Figure 13:
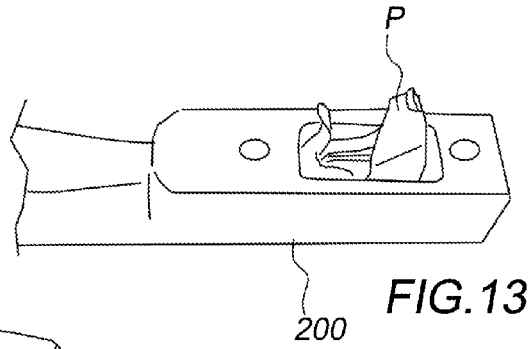
FIG. 13 is a detail view of an end of a stock according to a preferred embodiment.
Figure 14:
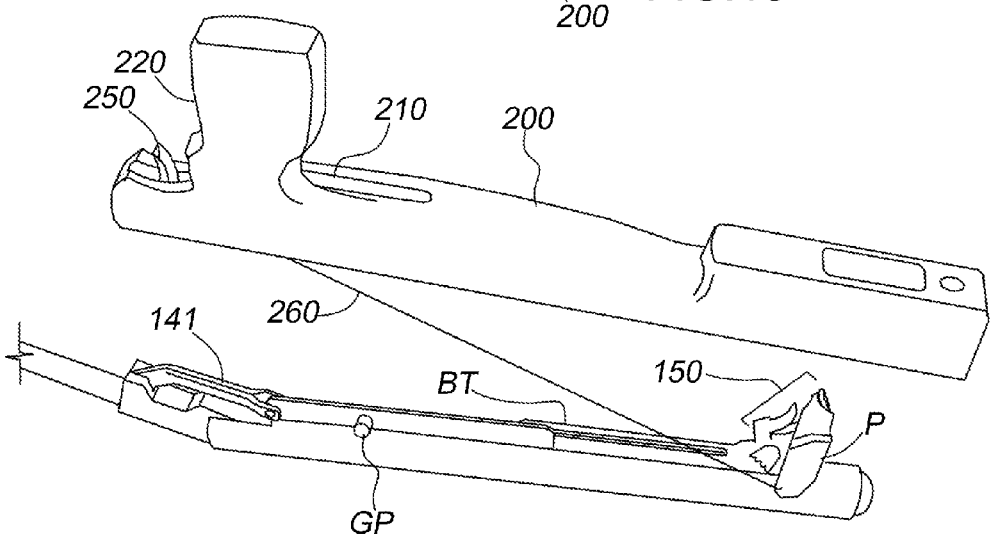
FIG. 14 is a perspective view showing the orientation of mechanical components of a typical break barrel air rifle and a stock according to a preferred embodiment.

Moving to FIGS. 13 and 14, a detail view shows an OEM trigger projecting from the rear of stock 200. Also shown is plate (P) which is a lever whereby the rear OEM trigger is actuated by forward trigger 250 by means of cable linkage 260.

Figure 15:
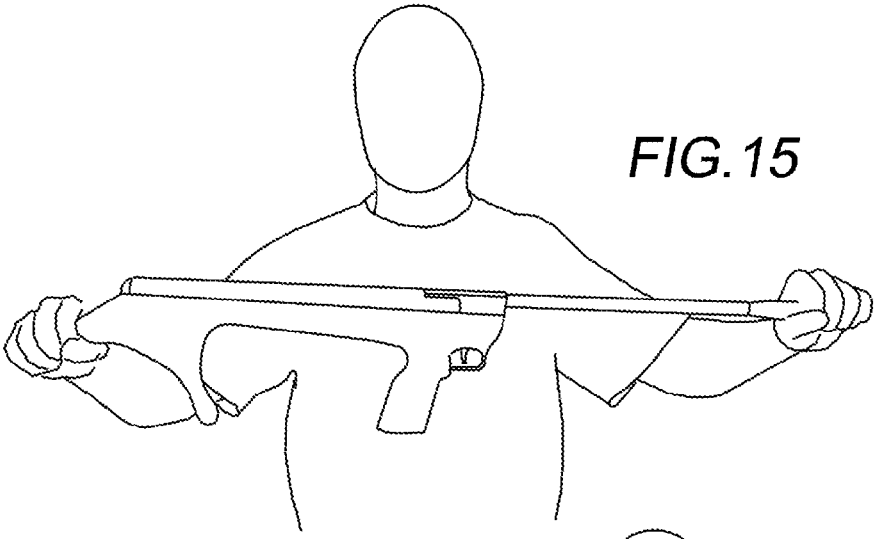
FIGS. 15-17 show respectively, the steps for cocking a preferred embodiment according to the present invention, that includes gripping the ends of the stock and barrel and placing the grip 220 against the chest, using the grip as a fulcrum, breaking the barrel in a direction that is generally toward the body, and continuing the breaking motion and lowering the arms to greater advantage.
Figure 16:
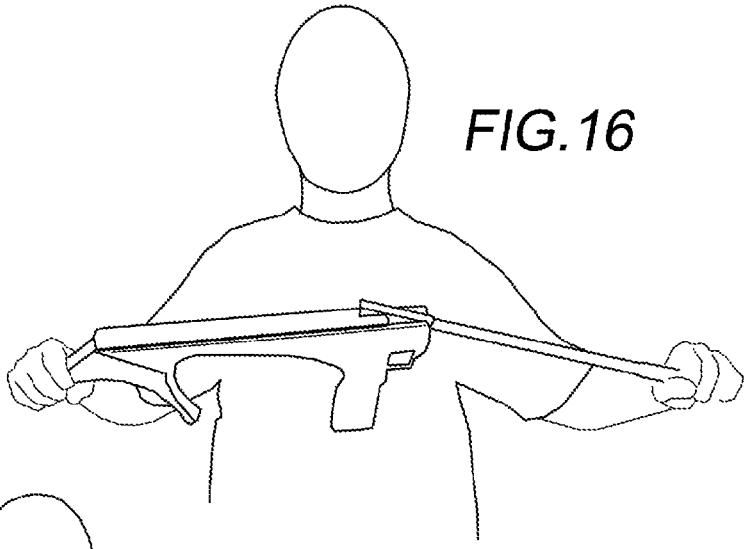
Figure 17:
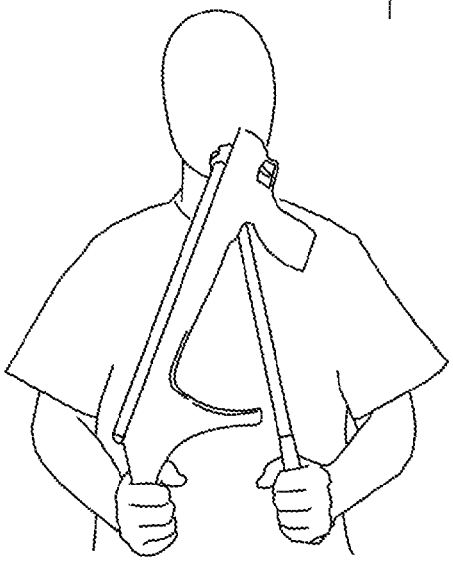

In sequential views FIGS. 15-17 depict a preferred cocking method: (1) the rifle is gripped at the ends with the grip 220 pointed toward the torso, (2) the rifle is "broken" to initiate the cocking process using the grip as a fulcrum, and (3) in the final stage of cocking, the pivot point between the air cylinder and the barrel is raised with the hands lowered to ease completion of the final cocking stage. The saddle shaped buttstock 290 produces a sure grip that both enables and eases the foregoing cocking process.

Figure 18:
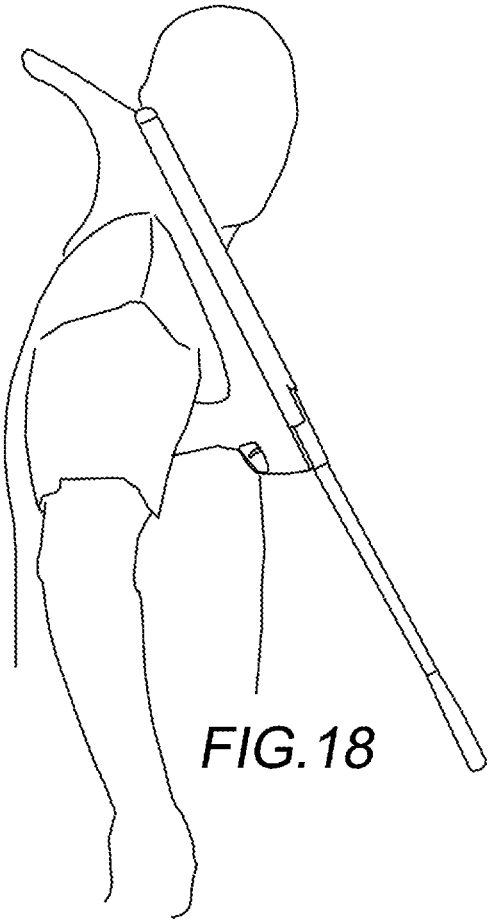
FIG. 18 shows a buttstock of one embodiment placed over the shoulders for hands-free support of the rifle.

FIG. 18 shows an embodiment wherein the buttstock is resting atop a shoulder without the need of a shoulder strap.

Figure 19:
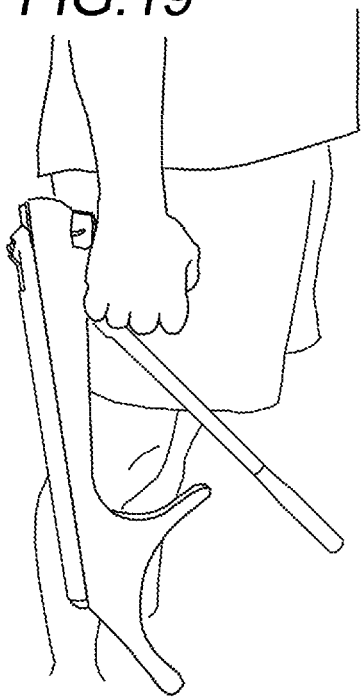
FIG. 19 is a perspective view illustrating a carrying method corresponding to a preferred embodiment of the present invention.

FIG. 19 depicts an embodiment in a compact carry position wherein the safety is engaged.

Figure 20:
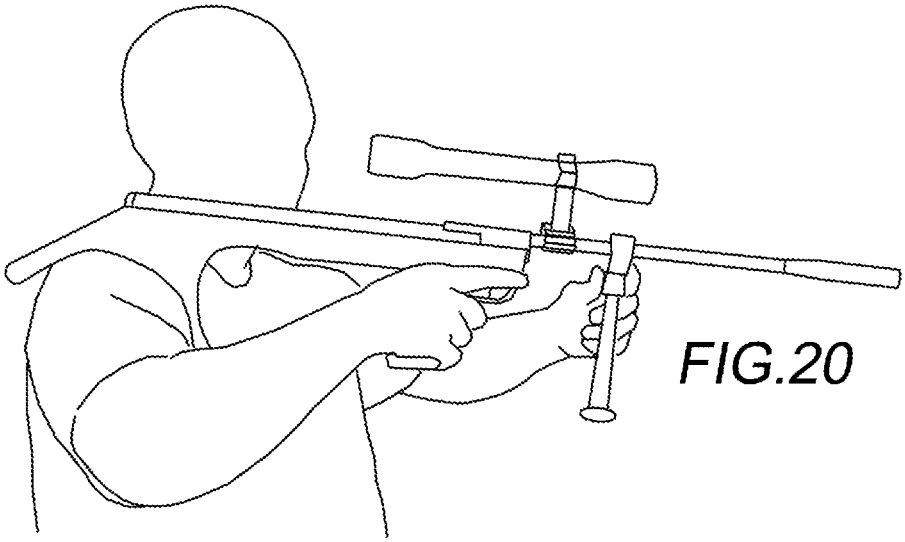
FIG. 20 is a perspective view illustrating an embodiment in ready position.

FIG. 20 shows an embodiment in a ready (aiming) position. The shape, size and positioning of the stock shortens the distance between a gun sight or scope, and the shooter's eyes when sighting. The form also permits one's arms to be comfortably flexed and closer to one's trunk in contrast with the extended arm position assumed with conventional stocks. The stock assembly therefore improves body mechanics, reduces fatigue and provides other surprising advantages flowing therefrom.

Figure 21:
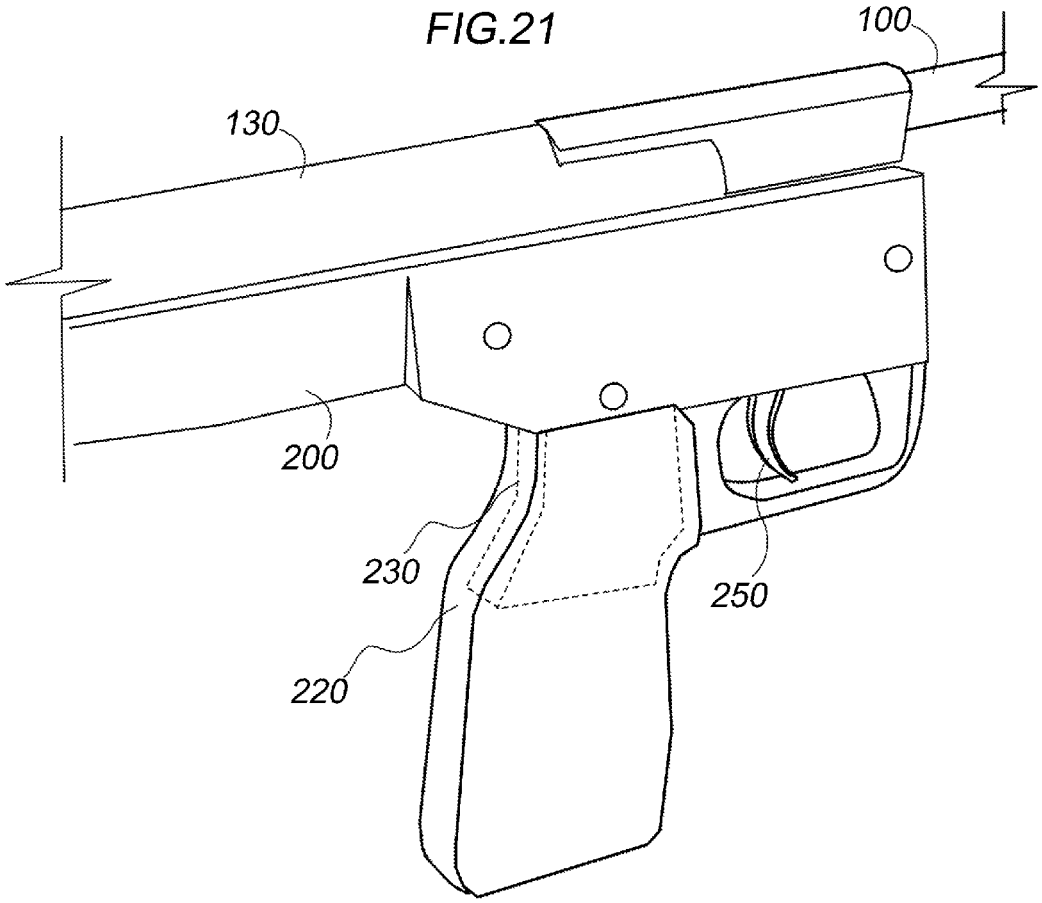
FIG. 21 is a detail view illustrating an offset interchangeable pistol grip and trigger assembly to one side of slot 210.

FIG. 21 in one embodiment, depicts a removable/interchangeable grip wherein the dotted lines represent a stub 230 for attaching a desired grip.

It should be understood that the stock, buttstock and other elements of the stock assembly can be made of any plastic, metal or composite. Moving back to FIG. 7, preferably, grip 220 is between 10 and 20 degrees of vertical. However, grip 220 can extend at any angle or perpendicularly relative to stock 200 and adjacent to slot 210. It is conceivable that a grip may be switched and secured from a right side to a left side of the stock depending on user preference.

Figure 22A:
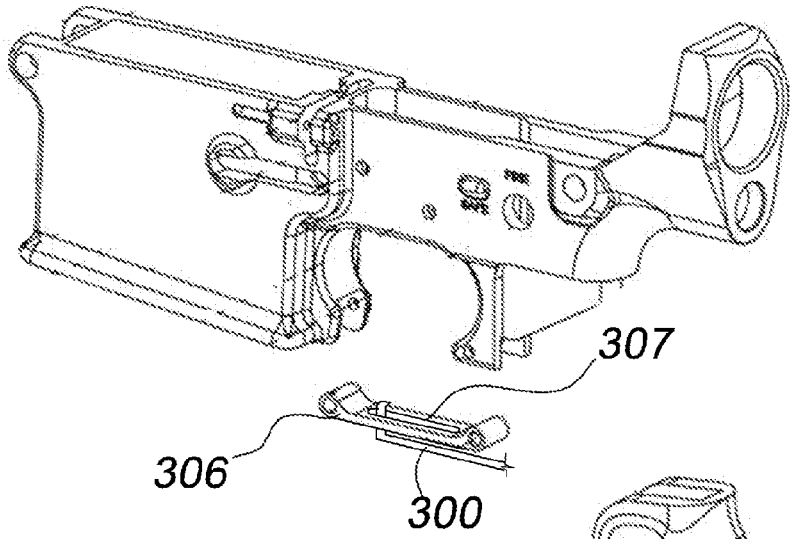
FIG. 22*as* a partial view of a stock AR15 lower receiver with modified disengageable trigger guard.
Figure 22B:
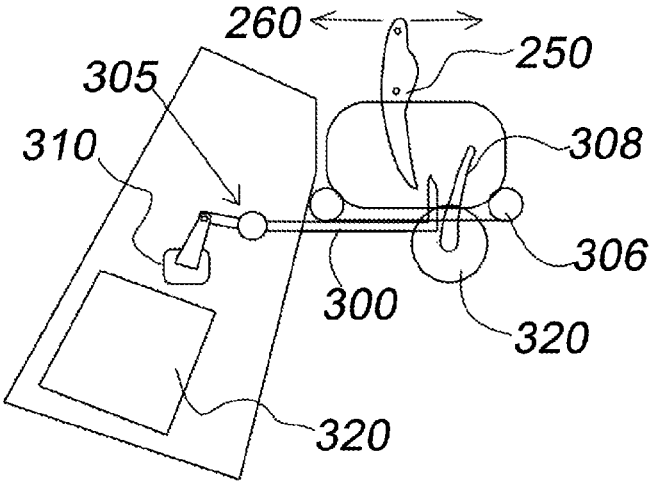
FIG. 22*b* in a schematic diagram shows the configuration of a augmented trigger pull assembly.
Figure 22B:
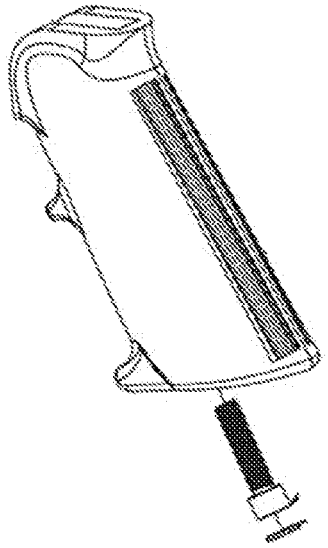

Other advantages flowing from the present invention are the mounting of a scope and/or a bipod along the barrel length. The present invention can be used with a picatinney rail. It is conceivable that certain mechanically assisted means be added to forward trigger 250 to reduce the trigger pull force required. For example, a battery operated servo within the grip (FIG. 22*b*) can sense and then augment finger pressure by applying additional pulling force to cable 260.

In an implementation of the invention applicable to both break barrel guns and rifles such as the AR15, a trigger guard 306 (FIG. 22*a*) is modified with a slot 307 therein forming a channel along which a actuated drawbar 300 travels. The drawbar is linked to a servo 310 that pulls the drawbar at a rate determined by the movement of auxiliary trigger 308 which is coupled to a potentiometer 320. When the auxiliary trigger or secondary trigger is drawn, the resistance of the potentiometer is varied which determines the rate of travel of the servo 310 which pulls and forces the drawbar against the primary trigger. Tension may be varied for the auxiliary trigger by a spring or other means that will be appreciated by those having skill in the art. It is therefore possible to reduce the trigger pull force considerably; in the case of air rifles, for example, from 5 lbs to 2 lbs or less, and provide greater accuracy resulting from smoother trigger motion. Alternatives to the servo include a small motor and pulley that winds a wire or cable connecting the drawbar. Any type of potentiometer may be employed including linear potentiometers.

While the present invention compared to past stock design lightens a rifle, It is conceivable that other improvements to the conventional break barrel configuration will reduce weight even further. Conceivably, the piston which is typically a steel alloy can be replaced with one of carbon fiber or other lightweight composite. One advantage of a lighter weight piston would be less recoil and greater accuracy. The back spring guide can also be substituted with a lighter material such as carbon fiber or aluminum.

In view of the many possible embodiments to which the principles of the disclosed invention may be applied, it should be recognized that the illustrated embodiments are only preferred examples of the invention and should not be taken as limiting the scope of the invention. Therefore, this disclosure is intended to cover such alternatives, modifications, and equivalents as may be included in the spirit and scope of the description in view of the appended drawings and claims.

What is claimed is:

1. A special stock assembly for a break barrel air gun comprising:

(1) a bull-pup stock including a front portion, a rear portion, a right side, a left side and the bull-pup stock further including one or more recesses for attachment to and over portions of the air gun, and a slot formed therein for the passing through of portions of a cocking mechanism and a portion of the barrel of the air gun; and, (2) a grip located substantially at the front portion of the stock and defining a fulcrum for assisted cocking of the gun, at or adjacent to a pivot point of the cocking mechanism.

2. The special stock assembly according to claim 1 further comprising a trigger action adjacent the grip.

3. The special stock assembly according to claim 1 further comprising a buttstock having portions thereof shaped and sized to fit atop a shooter's shoulder and configured to permit hands-free resting of the gun in a downwardly pointing direction.

4. The special stock assembly according to claim 1 wherein at least portions of the grip are located to one side of the slot.

* * * * *